US005326024A

United States Patent [19]

Fogle

[11] Patent Number: 5,326,024

[45] Date of Patent: Jul. 5, 1994

[54] CARTON WITH RECLOSABLE POURING OPENING

[75] Inventor: James C. Fogle, Marietta, Ga.

[73] Assignee: Riverwood International Corporation, Atlanta, Ga.

[21] Appl. No.: 128,980

[22] Filed: Sep. 29, 1993

[51] Int. Cl.[5] ..... B65D 5/70; B65D 5/74

[52] U.S. Cl. ..... 229/214; 229/125.42; 229/217

[58] Field of Search ..... 229/213, 214, 216-219, 229/125.42

[56] References Cited

U.S. PATENT DOCUMENTS

| | | | |
|---|---|---|---|
| 1,157,462 | 10/1915 | Van Wormer | 229/214 |
| 2,333,123 | 11/1943 | Ringler | 229/214 |
| 2,470,199 | 5/1949 | Vivian | 229/213 |
| 2,750,095 | 6/1956 | Alden | 229/214 |
| 3,022,930 | 2/1962 | Kuchenbecker | 229/214 |
| 3,040,950 | 6/1962 | Kuchenbecker | 229/214 |
| 3,040,951 | 6/1962 | Kuchenbecker | 229/214 |
| 3,306,514 | 2/1967 | MacKendrick | 229/219 |
| 3,770,185 | 11/1973 | Reeves | 229/213 |
| 4,813,546 | 3/1989 | Gordon et al. | 229/125.42 |

FOREIGN PATENT DOCUMENTS

| | | | |
|---|---|---|---|
| 679492 | 2/1964 | Canada | 229/125.42 |

*Primary Examiner*—Gary E. Elkins

[57] ABSTRACT

A carton for packaging pourable material. Upper end panel sections are connected by gussets to sloped upper side panel sections, and the latter are connected by overlapping horizontal flaps. Separation of an end tear strip portion of the horizontal flaps allows an upper end panel section to be folded out to form a pouring spout configuration. The tab remaining after separation of the tear strip portion is inserted in a slit in the upper end panel section to hold the section in place after being reclosed.

4 Claims, 3 Drawing Sheets

CARTON WITH RECLOSABLE POURING OPENING

FIELD OF THE INVENTION

This invention relates to cartons for packaging pourable material. More particularly, it relates to cartons of this type which contain closable pouring openings.

BACKGROUND OF THE INVENTION

Particles or flakes of dry material, such as cereal, are conventionally packaged in rectangular boxes having a top panel which can be opened to gain access to the contents. Typically, the top panel includes overlapping flaps connected to the side panels and underlying glue flaps connected to the end panels. The package is opened by separating the outer top panel flap from the inner top panel flap, and is closed by inserting an end tab on the outer flap into a locking slot in the inner flap. The slot is initially hidden from view by the overlapping flap and is exposed upon separating the two flaps. A common complaint against this package design is the difficulty in separating the flaps. The glue adhering the overlapping flaps to each other and to the underlying short glue flaps is often so strong or so liberally applied that the outer flap tears instead of separating along the glue line. If the tab is completely torn off, the top panel flaps cannot be connected together to close the package. Even if the tab is only partially torn or the outer flap is weakened by tearing in other areas, the flaps cannot normally be securely held in place after opening.

Another complaint against the conventional package has to do with pouring the contents. Pouring takes place over an end edge of the top opening and over the adjacent end glue flap. This relatively wide area makes it difficult to control the flow of the particles, sometimes resulting in the particles spilling out over the outer sides of the glue flaps.

It would be desirable to be able to package pourable material in cartons that can be easily opened without tearing and readily closed again to a secure position. It would also be desirable to be able to better direct the flow of the contents during pouring.

BRIEF SUMMARY OF THE INVENTION

The carton of the invention overcomes the abovementioned problems. Its basic construction is conventional, comprising side panels, end panels and a bottom panel connected to each other. Also included are upper sloped panel sections connected to the side panels along fold lines and upper end panel sections connected to the end panels along fold lines, with the upper end panel sections being connected to the upper sloped panel sections by gusset panels. The inwardly folded gusset panels exert a biasing force which tends to hold the upper end panel sections in closed condition. In addition to the biasing action of the gusset panels, additional means are provided for holding the upper sloped panel sections and upper end panel sections in closed condition and for permitting the carton to be opened and reclosed.

The additional means for holding the upper sloped panel sections and upper end panel sections in closed condition may comprise a flap attached to one of the upper sloped panel sections and connected to the other upper sloped panel section. In a preferred arrangement a second flap is attached to the other upper sloped panel section, and the flaps are overlapped and adhered to each other so that they are substantially horizontal when the carton is resting on the bottom panel.

The means for permitting the carton to be opened at an upper end may comprise a tear strip connected to the upper sloped panel sections, preferably forming an end portion of the overlapped flaps. When the tear strip is separated, access is provided to the associated upper end panel section, enabling it to be reached and pivoted out. The resulting outward folding of the gusset panels creates a spout-like configuration through which the contents of the package can be poured. Means are also provided to hold the upper end panel section in place after reclosing the carton.

The carton can be readily opened without destroying or damaging its pouring and reclosing features and can be economically formed from a blank of generally rectangular shape.

These and other features and aspects of the invention, as well as its various benefits, will be made more clear in the subsequent detailed description of the preferred embodiment.

DETAILED DESCRIPTION OF THE PREFERRED EMBODIMENT

Figure 1:
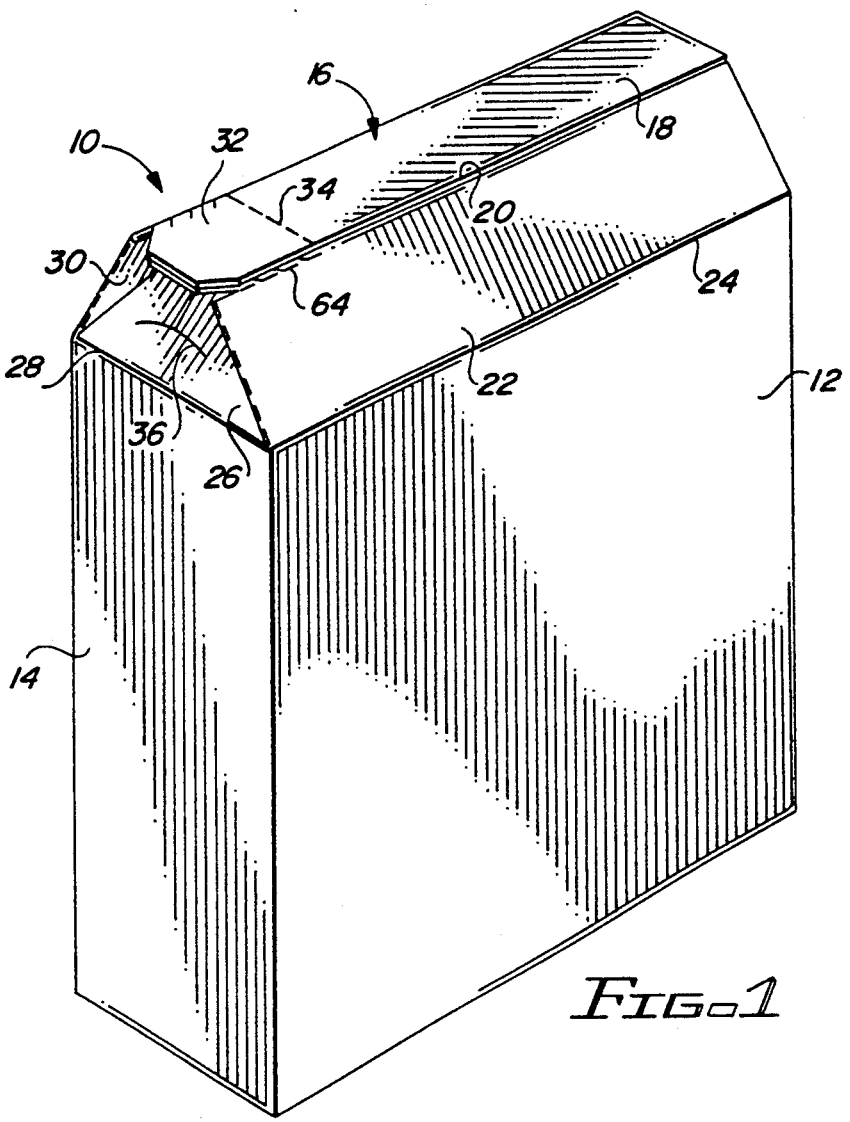
FIG. 1 is a pictorial view of the carton of the invention.
Figure 2:
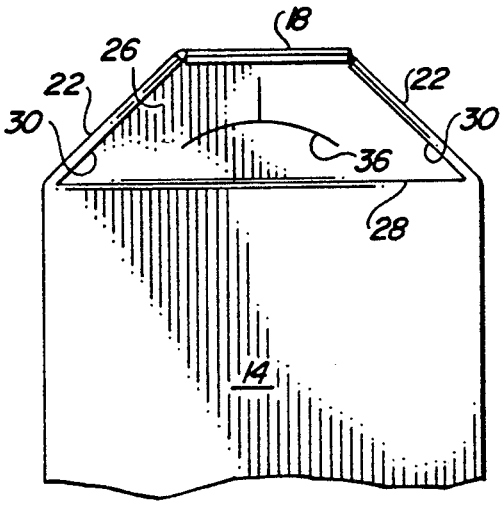
FIG. 2 is a partial end view of the carton, showing the end portion of the carton designed to be opened.

Referring to FIGS. 1 and 2, the carton 10 is comprised of side panels 12 connected to end panels 14 and to a bottom panel, not visible in this view. The top portion 16 of the carton includes a relatively narrow flat top panel section 18 connected along fold lines 20 to upper sloped sections 22, which in turn are connected along fold lines 24 to the side panels 12. Upper end panel sections 26 are connected to the end panels 14 along fold lines 28 and to the sloped sections 22 by means of gusset panels 30. The top flat section 18 includes a tear-away tab 32 which is connected to the top flat section 18 along fold line 34 and is adapted to engage in locking slit 36 in the upper end panel section 26 after the package has been opened, as explained more fully below.

Figure 3:
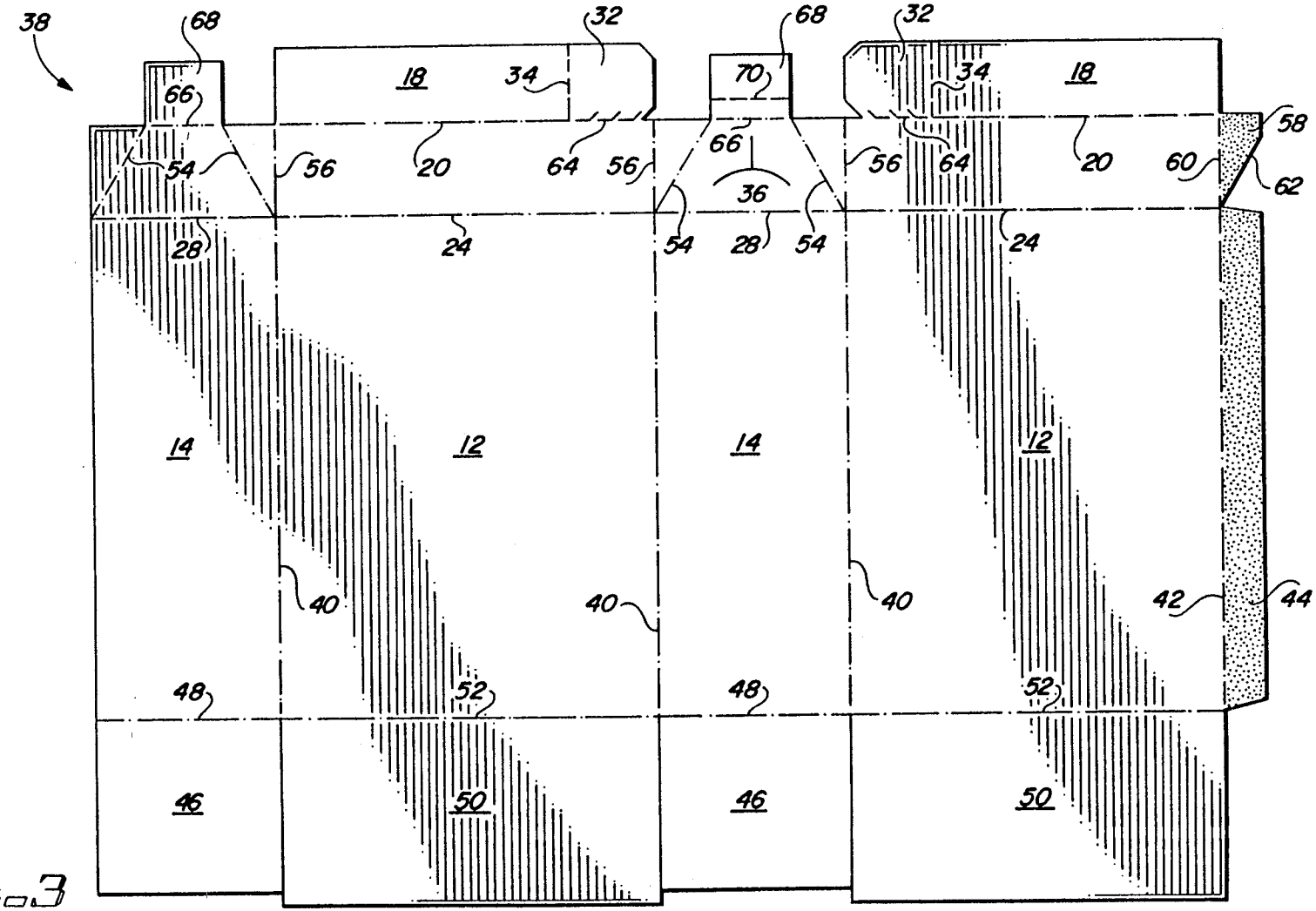
FIG. 3 is a plan view of a blank for forming the carton of FIG. 1.

The carton is formed from the blank 38 of FIG. 3, which can be seen to be generally rectangular in shape. Side panel sections 12 are connected to the end panel sections 14 by fold lines 40, with the side panel section at one end of the blank also being connected along fold line 42 to glue flap 44. Bottom glue flaps 46 are connected to the end panel sections 14 along fold lines 48 and bottom panel flaps 50 are connected to the side panel sections 12 along fold lines 52.

The gusset panels 30 are connected to the upper end panel sections 26 along angled fold lines 54 and to the upper sloped sections 22 along fold lines 56, which are extensions of the fold lines 40. A gusset glue flap 58 is connected to the end sloped section 22 along fold line 60. The gusset glue flap is separated from the main glue flap 44 by a lower edge 62 which forms substantially the same angle with the fold line 60 as the fold lines 54 make with the fold lines 56. Each sloped section 22 is connected to a similar top panel flap 18 which forms the top flat section of the carton, and the tabs 32 comprise the interior ends of the flaps. The tabs 32 are connected to the sloped sections 22 along weakened lines, such as the so-called zipper cuts 64, to enable the tabs to be readily separated from the sloped sections.

Connected to the upper end panel sections 26 along fold lines 66 are flaps 68, the width of which is approximately the same as the width of the top panel flaps 18. The flap 68 associated with the end panel section in which the locking slit 36 is incorporated may be provided with a weakened line, such as the partially slit line 70, spaced from and parallel to the fold line 66.

To form the carton of FIG. 1, the blank is folded along the outermost fold lines 40 and the left edge of the blank, as viewed in FIG. 3, is glued to the glue flaps 44 and 58 in the areas shown in stipple. The glue flap 58 overlies the end gusset panel 30, with the lower edge 62 of the gusset glue flap 58 substantially coinciding with the outer gusset panel fold line 54. This creates a collapsed carton sleeve, which is the form in which the cartons are introduced to a packaging machine. In the packaging machine the collapsed sleeve is opened to form a sleeve, after which the bottom glue flaps 46 are folded in and the bottom panel flaps 50 folded in on top of them. One of the bottom panel flaps 50 is folded in first to become the inner bottom panel flap and the other flap 50 is folded to overlie the other. The inner bottom flap 50 is glued to the glue flaps and the outer bottom flap 50 is glued to the underlying bottom flap during this operation.

Figure 4:
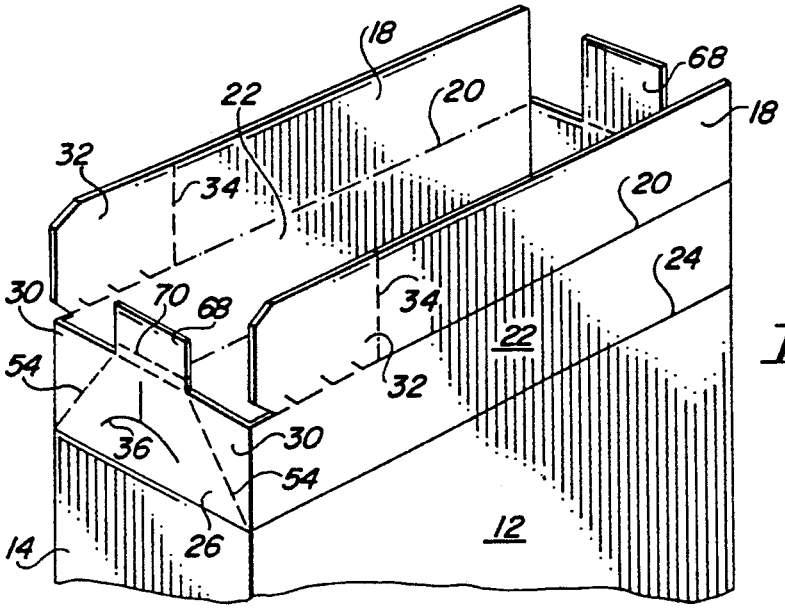
FIG. 4 is a partial pictorial view of the carton of FIG. 1, showing the top in open condition prior to filling the carton.

All of the forming steps described to this point are conventional, resulting in a carton at an interim stage of fabrication having a closed bottom panel and an open top. The upper portion of the partially formed carton is illustrated in. FIG. 4, which shows the sloped panels 22 and top panel flaps 18 extending vertically up as a continuation of side panels 12 and the upper end panel sections 26, the gusset panels 30 and the tabs 68 extending up as a continuation of end panels 14. The carton is filled with the flaps in this condition, or with the flaps 18 and tabs 68 folded back at an angle to the vertical in order to provide additional clearance for the filling operation. After the filling operation, it is merely necessary to exert an inward force on the upper end panel sections 26 to bring the sloped panel sections 22 to their inwardly angled position. This automatically occurs as a result of inward movement of the gusset fold lines 54, which causes the gusset panels at each end of the carton to fold in toward each other. The top of the carton is completed by folding the top panel flaps 18 toward each other so that one of them overlaps and ,is glued to the other. The tabs 68 will have been moved down substantially to the horizontal by the downward folding of the top panel flaps 18. The carton at this point appears as shown in FIG. 1.

Figure 5:
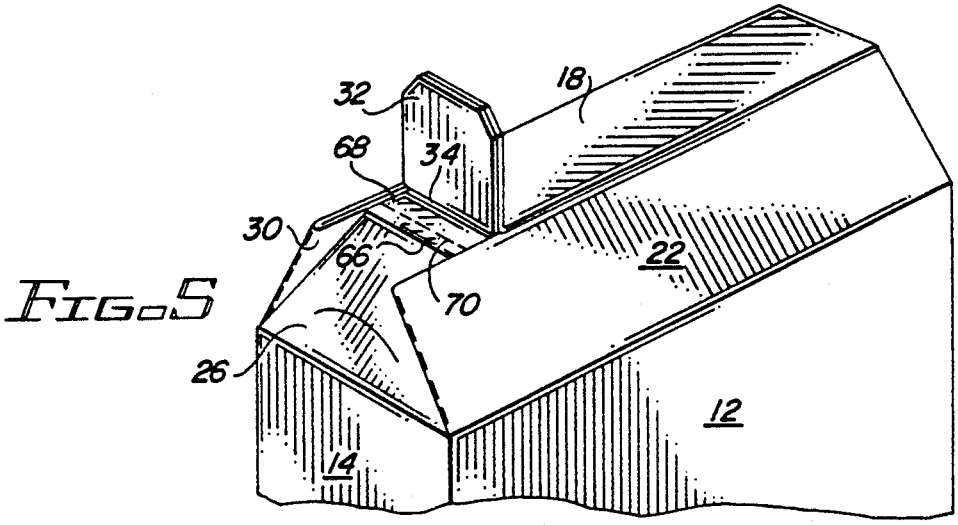
FIG. 5 is a partial pictorial view of the carton at an initial stage of opening.
Figure 6:
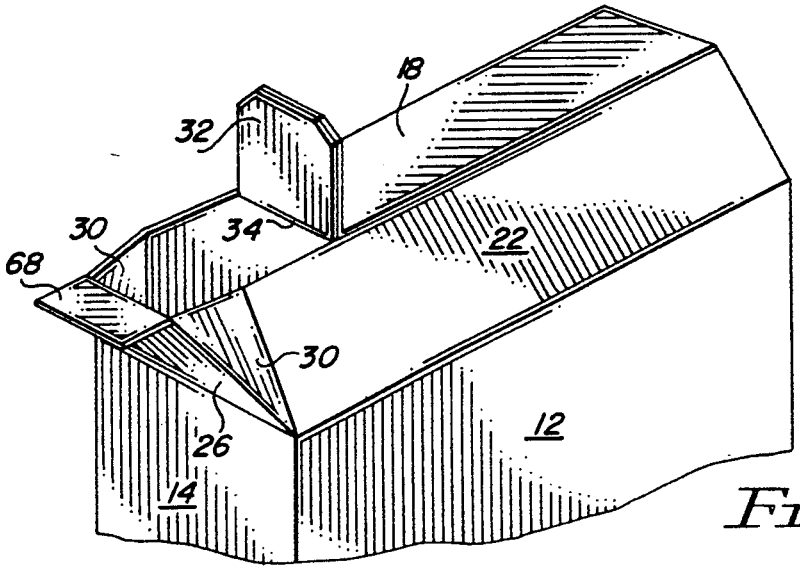
FIG. 6 is a partial pictorial view of the carton after it has been opened.

To open the carton the tabs 32 are grasped and lifted, causing them to separate along the tear lines 64 and to be pivoted up about the fold lines 34. Both of the adhered tabs are separated and pivoted up as a unit to the point illustrated in FIG. 5, which provides access to the fold line 66 at the upper edge of the upper end panel section 26. To complete the opening process, it is merely necessary to reach in to the upper edge and pull the upper end panel section 26 out. The upper end panel section pivots out about its fold line 28, and at the same time the gusset panels fold out to form the configuration illustrated in FIG. 6. The outwardly folded gusset panels form a spout-like opening through which the contents of the carton can readily and freely flow. The outwardly folded tab 68 preferably is formed with the partially severed line 70 described above so that the pressure exerted on the tab by the user in opening the carton will sever the tab along this line, resulting in a very short remaining tab which forms the outer edge of the spout and over which the contents of the carton can flow.

Figure 7:
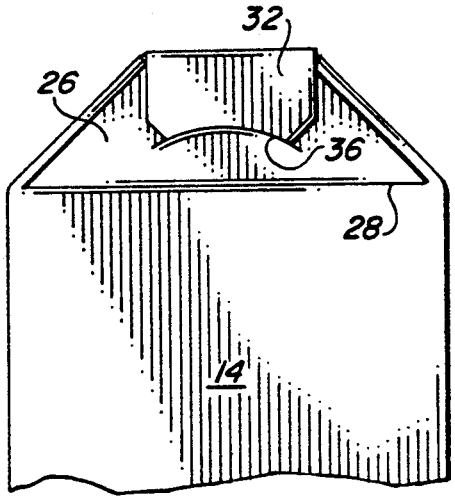
FIG. 7 is a partial end view of the carton, showing the end portion after it has been reclosed.

To close the carton it is merely necessary to push the upper end panel section 26 back to its original closed position, causing the gusset panels to snap back to their closed position, thereby holding the upper end panel section securely in place. The tabs 32 are then folded down to fully close the opening and are inserted into the slit 36, which maintains the top panel construction in the closed condition shown in FIG. 7 until the next use.

It will be appreciated that the design of the invention allows the carton to be opened without having to overcome excessive or unwanted applications of glue and provides a convenient pouring spout opening configuration. The carton is easily closed, and is maintained in closed condition by the biasing force of the gusset panels and by the tab and slot arrangement at the end of the top panel section. Moreover, the carton is basically rectilinear in shape, which permits the cartons to be stacked.

It should be apparent that the invention is not necessarily limited to all the specific details described in connection with the preferred embodiment, but that changes to certain features of the preferred embodiment which do not alter the overall basic function and concept of the invention may be made without departing from the spirit and scope of the invention defined in the appended claims.

What is claimed is:

1. A carton for packaging pourable material, comprising:

opposite side panels connected to opposite end panels and to a bottom panel;

an upper sloped panel section connected to each of the side panels along a fold line;

an upper end panel section connected to each of the end panels along a fold line;

gusset panels connecting each of the upper end panel sections to the upper sloped panel sections;

means in addition to the gusset panels for holding the upper sloped panel sections and upper end panel sections in closed condition;

a tear strip connected to the upper sloped panel sections, the tear strip extending from an end of the carton adjacent one of the upper end panel sections to a point spaced therefrom to form a tab when the tear strip is separated from the upper sloped panel sections back to said point, whereby separation of the tear strip allows access tot he adjacent upper end panel section to permit said adjacent upper end panel section to be pulled outwardly, pivoting down about the fold line connecting said adjacent upper end panel section to the end panel associated therewith and causing the gusset panels connected to said adjacent upper end panel section to fold outwardly; and said adjacent upper end panel section including a slit for receiving the end portion of said tab to maintain said adjacent upper end panel section in closed position after it has been reclosed by pivoting said adjacent upper end panel section up about said fold line to cause the associated gusset panels to fold inwardly.

2. A carton for packaging pourable material as defined in claim 1, wherein the means in addition to the gusset panels for holding the upper sloped panel sections and the upper end panel sections in closed condition comprises a flap attached to one of the upper sloped panel sections and connected to the other sloped panel section, the flap being substantially horizontal when the carton is resting on the bottom panel.

3. A carton for packaging pourable material, comprising:

opposite side panels connected to opposite end panels and a bottom panel;

an upper sloped panel section connected to each of the side panels along a fold line;

an upper end panel section connected to each of the end panels along a fold line;

gusset panels connecting each of the upper end panel sections to the upper sloped panel sections;

a flap attached to one of the upper sloped panel sections and connected to the other upper sloped panel section, the flap being substantially horizontal when the carton is resting on the bottom panel;

a tear strip comprised of an end portion of the flap connected to the upper sloped panel sections, the tear strip extending from an end of the carton adjacent one of the upper end panel sections to a point spaced therefrom to form a tab when the tear strip is separated from the upper sloped panel sections back to said point, whereby separation of the tear strip allows access to the adjacent upper end panel section to permit said adjacent upper end panel section to be pulled outwardly, pivoting down about the fold line connecting said adjacent upper end panel section to the end panel associated therewith and causing the gusset panels connected to said upper end panel section to fold outwardly; and end flaps connected to the upper end panel sections and extending toward the opposite end panels, on of the end flaps underlying the tear strip including a weakened transversely extending line, the weakened line enabling said one end flap to sever to form a shorter flap over which contents of the carton can be poured.

4. A generally rectangular blank for forming a carton for packaging pourable material, comprising:

alternating side and end panel sections connected by first fold lines;

bottom panel flaps connected to the side and end panel sections along second fold lines extending at substantially right angles to the first fold lines;

upper side panel sections connected to the side panel sections and upper end panel sections connected to the end panel sections along third fold lines substantially parallel to the second fold lines;

gusset panels connected the upper side panel sections to the upper end panel sections along fold lines;

a first flap attached to one of the upper side panel sections;

a second flap attached to the other upper side panel section, the flaps being adapted to be overlapped and adhered to each other;

a tear strip at one end of the flaps, the tear strip being of a length such that separation thereof from the upper side panel sections allows access to the upper end panel section adapted to be adjacent the tear strips in a carton formed from the blank to permit the latter upper end panel section to be pulled outwardly, pivoting down about its third fold line to cause the gusset panels connected to said upper end panel section to fold outwardly; and said latter upper end panel section including a slit for receiving the end portion of the tear strip to maintain said latter upper end panel section in closed position after it has been reclosed.

* * * * *